US009034106B2

(12) United States Patent
Chan et al.

(10) Patent No.: US 9,034,106 B2
(45) Date of Patent: May 19, 2015

(54) SMOKING ARTICLE INCLUDING ALKANOYLATED GLYCOSIDE

(75) Inventors: W. Geoffrey Chan, Henrico, VA (US); Christophe Galopin, Rye Brook, NY (US); Andreas Czepa, Richmond, VA (US); Mike Nuckols, Midlothian, VA (US); Beverley Woodson, Ruther Glen, VA (US)

(73) Assignee: Philip Morris USA Inc., Richmond, VA (US)

( * ) Notice: Subject to any disclaimer, the term of this patent is extended or adjusted under 35 U.S.C. 154(b) by 1090 days.

(21) Appl. No.: 12/748,216

(22) Filed: Mar. 26, 2010

(65) Prior Publication Data

US 2011/0232655 A1 Sep. 29, 2011

(51) Int. Cl.
*A24B 15/30* (2006.01)
*A24B 15/40* (2006.01)

(52) U.S. Cl.
CPC ..... *A24B 15/403* (2013.01)

(58) Field of Classification Search
None
See application file for complete search history.

(56) References Cited

U.S. PATENT DOCUMENTS

| | | | | |
|---|---|---|---|---|
| 2,766,145 | A | 10/1956 | Jones | |
| 3,008,474 | A | 11/1961 | Touey et al. | |
| 3,095,882 | A | 7/1963 | Hind et al. | |
| 3,332,428 | A | 7/1967 | Mold et al. | |
| 3,938,531 | A | 2/1976 | von Castelmur | |
| 3,964,495 | A * | 6/1976 | White | 131/359 |
| 4,804,002 | A | 2/1989 | Herron | |
| 4,819,665 | A | 4/1989 | Roberts et al. | |
| 4,836,224 | A * | 6/1989 | Lawson et al. | 131/336 |
| 4,881,556 | A | 11/1989 | Clearman et al. | |
| 4,903,714 | A | 2/1990 | Barnes et al. | |
| 4,938,238 | A | 7/1990 | Barnes et al. | |
| 4,989,619 | A | 2/1991 | Clearman et al. | |
| 4,991,596 | A * | 2/1991 | Lawrence et al. | 131/194 |
| 5,065,776 | A | 11/1991 | Lawson et al. | |
| 5,133,368 | A | 7/1992 | Neumann et al. | |
| 2005/0076927 | A1 * | 4/2005 | Schluter et al. | 131/339 |

FOREIGN PATENT DOCUMENTS

| | | | |
|---|---|---|---|
| CN | 101077217 | A | 11/2007 |
| GB | 1508616 | | 4/1978 |
| GB | 1508617 | | 4/1978 |
| JP | 3-266969 | A | 11/1991 |
| JP | 5219929 | | 8/1993 |
| JP | 2009148233 | A * | 7/2009 |

OTHER PUBLICATIONS

Nicotine Document on Wikipedia.*
Nicotine from Wikipedia (http://en.wikipedia.org/wiki/Nicotine) printed on Nov. 17, 2012.*

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

A smoking composition for inclusion in a combustible smoking article includes a combustible organic material, such as tobacco and/or tobacco substitutes and at least one alkanoylated glycoside for enhancing the flavor of mainstream smoke. Optionally, dry hops extract can also be included in the smoking composition.

10 Claims, 1 Drawing Sheet

(56) References Cited

OTHER PUBLICATIONS

International Preliminary Report on Patentability issued Oct. 2, 2012 for PCT/IB2011/001100.

Database WPI, Week 199203, Thomson Scientific, London, GB, AN 1992-019310, Jan. 1992.

Database WPI, Week 200828, Thomson Scientific, London, GB, AN 2008-D86441, Jul. 2008.

* cited by examiner

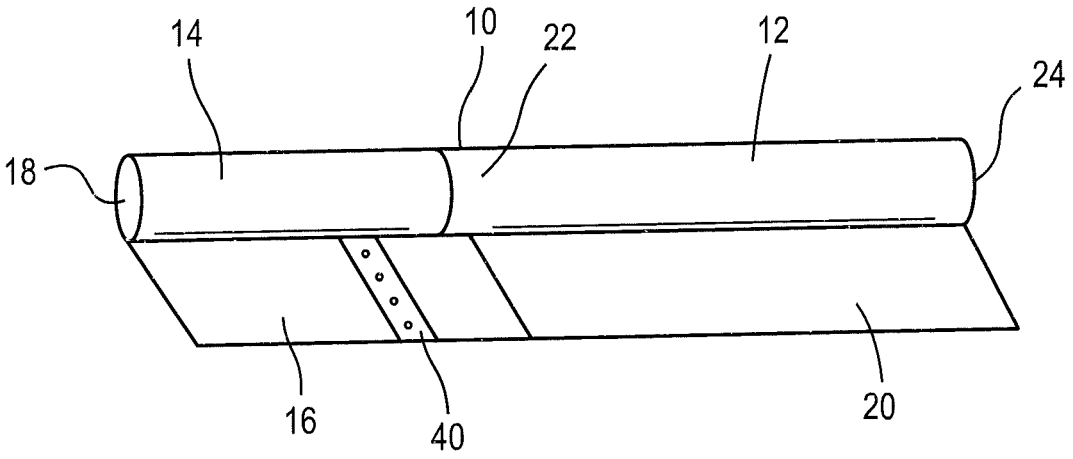
14
10
22
12
24
18
16
40
20

SMOKING ARTICLE INCLUDING ALKANOYLATED GLYCOSIDE

SUMMARY

In one embodiment, a combustible smoking composition comprises a combustible organic material, such as tobacco and/or tobacco substitutes; and an alkanoylated glycoside of the formula:

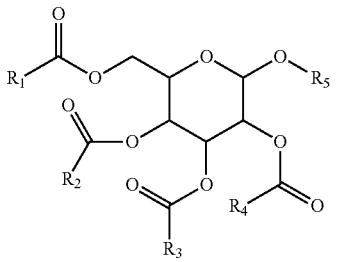

wherein R1, R2, R3 and R4 are selected from the group consisting of C1-C6 alkyl groups and H, and R5 is selected from the group consisting of H, a C1-C6 acyl group, a C1-C6 alkyl group, an aroyl group and an aryl group. Desirably, at least one of R1, R2, R3, and R4 are not H. The alkanoylated glycoside is dispersed on the combustible organic material. Preferably, the alkanoylated glycoside is included in the smoking composition in an amount ranging from about 100 mg/kg of combustible organic material to about 300 mg/kg of combustible organic material. Preferably, the alkanoylated glycoside is an acetylated glycoside.

In another embodiment, a smoking article comprises a rod comprising the combustible smoking composition disclosed herein. More particularly, the smoking article comprises tobacco and/or tobacco substitutes and at least one alkanoylated glycoside of the formula:

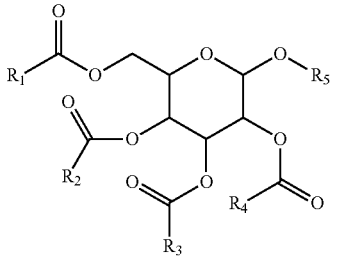

wherein R1, R2, R3 and R4 are selected from the group consisting of C1-C6 alkyl groups and H, and R5 is selected from the group consisting of H, a C1-C6 acyl group, a C1-C6 alkyl group, an aroyl group and an aryl group. Desirably, at least one of R1, R2, R3, and R4 are not H. The smoking article further desirably includes a filter. Optionally, the filter can include at least one sorbent, such as activated carbon. Ventilation holes can be formed along the length of the smoking article or otherwise deposited in the smoking article, including in the filter.

In another embodiment, the smoking article can include hops extract, in particular dry hops extract. This can be added in addition to, or in lieu of the alkanoylated glycoside described above. When included, the dry hops extract is desirably present in the smoking composition in an amount of about 1 mg to about 50 mg per smoking article. The dry hops extract can be mixed with tobacco and/or tobacco substitute or optionally included in reconstituted tobacco sheets.

As used herein, the term "combustible organic material" includes any material suitable for use in a smoking composition, and can entirely contain tobacco, or can entirely contain a non-tobacco substitute for tobacco, or may be a combination of these. Suitable examples include botanical smoking compositions, such as sugar beet fiber, tea, herbs, vegetable material and combinations thereof.

In yet another embodiment, a method of making a smoking article comprises incorporating at least one alkanoylated glycoside in tobacco cut filler to form a smoking composition; forming a rod of smokable material comprising the smoking composition; placing a wrapper around the tobacco rod; and optionally attaching a filter to the rod of smokable material using tipping wrapper to form a smoking article. The at least one alkanoylated glycoside is of the formula

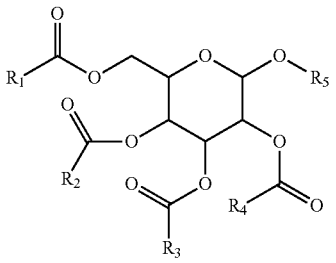

wherein R1, R2, R3 and R4 are selected from the group consisting of C1-C6 alkyl groups and H, and R5 is selected from the group consisting of H, a C1-C6 acyl group, a C1-C6 alkyl group, an aroyl group and an aryl group. Desirably, at least one of R1, R2, R3, and R4 are not H.

In still another embodiment, a smoking article comprises a rod comprising a combustible smoking composition and a filter disposed at an end of the rod. The smoking composition comprises a combustible organic material and hops extract. Preferably, the hops extract is dry hops extract. Moreover, the hops extract is included in the smoking article in an amount ranging from about 1 mg to about 50 mg per smoking article In yet another embodiment, a combustible smoking composition comprises combustible organic material, and hops extract dispersed on the combustible organic material. Preferably, the hops extract is dry hops extract.

BRIEF DESCRIPTION OF THE DRAWING

FIG. 1 is an illustration of a partially unwrapped smoking article including a smoking composition including at least alkanoylated glycoside as described herein.

DETAILED DESCRIPTION

Smoking compositions may include various compounds to alter the flavor of mainstream smoke. Carbon filtration and ventilation of smoking articles can be associated with an off taste by some smokers. Thus, enhanced mainstream smoke flavor is particularly desirable for smoking articles including carbon filtration systems and ventilation zones.

A combustible smoking composition including tobacco and at least one alkanoylated glycoside is provided herein. The combustible smoking composition can be incorporated in smoking articles. Preferably, the alkanoylated glycoside is included in an amount sufficient to alter the flavor of mainstream smoke when the tobacco is combusted, such that the carbon taste is offset and a richer tobacco flavor is provided. Desirably, the alkanoylated glycoside is an acetylated glycoside.

As used herein, the term "smoking article" includes cigarettes, cigars, and cigarillos and other articles in which a smokable composition, such as tobacco and/or tobacco substitute is lit and combusted to produce a mainstream smoke. The smoking article therefore generally has a "lit end" where combustion occurs and a "buccal end", from which mainstream smoke is withdrawn. Desirably, the buccal end has a filter, and is thus sometimes referred to herein as the "filter end". The term "smoking article" also includes non-traditional cigarettes such as cigarettes for electrical smoking systems, as described in commonly-assigned U.S. Pat. Nos. 6,026,820; 5,988,176; 5,915,387; and 5,499,636, are also included in the definition of smoking articles or cigarettes generally.

As used herein, the term "mainstream smoke" refers to the mixture of gases passing down the rod of the smoking article and issuing through the filter end, i.e., the amount of smoke issuing or drawn from the buccal end of a cigarette during smoking of the smoking article. The mainstream smoke contains gases that are drawn in through both the lighted region, as well as through the wrapper.

In a preferred embodiment, the combustible smoking composition includes tobacco and at least one alkanoylated glycoside. Preferably, the alkanoylated glycoside has the formula:

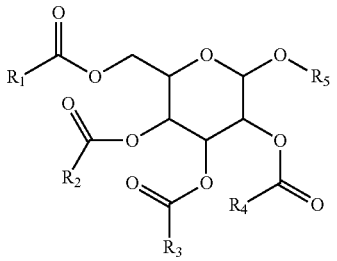

wherein R1, R2, R3 and R4 are selected from the group consisting of C1-C6 alkyl groups and H, and R5 is H, a C1-C6 alkanoyl group, a C1-C6 alkyl group, an aroyl group or an aryl group. Desirably, at least one of R1, R2, R3, and R4 are not H. The at least one alkanoylated glycoside is included in an amount sufficient to enhance the flavor of mainstream smoke. In the preferred embodiment, the alkanoylated glycoside can be included in the combustible smoking composition in an amount ranging from about 100 mg/kg of smoking material, e.g., tobacco to about 300 mg/kg of tobacco, more preferably in an amount ranging from about 150 mg/kg of tobacco to about 200 mg/kg of tobacco. For example, in a particular embodiment, the alkanoylated glycoside is an acetylated glycoside which can be included in the smoking composition in an amount of about 185 mg/kg of tobacco. In a particular embodiment, the acetylated glycoside is desirably dispersed throughout the tobacco material. Preferably, the acetylated glycoside is dispersed uniformly throughout the tobacco. In another embodiment, the acetylated glycoside is dispersed non-uniformly throughout the tobacco.

The R1, R2, R3, and R4 groups may be the same or different. In a preferred embodiment, at least one of R1, R2, R3, and R4 is a methyl group. In a particularly preferred embodiment, R1, R2, R3, and R4 are the same group, more preferably, R1, R2, R3, and R4 are each a methyl group. In the most preferred embodiment, the alkanoylated glycoside is glucose pentaacetate wherein R1, R2, R3 and R4 are methyl groups and R5 is an acetyl group. For example, a combustible smoking composition can be formed by combining tobacco or other botanical smoking material of tobacco substitute with α-D-glucose pentaacetate.

Not wishing to be bound by theory, it is believe that the alkanoylated glycoside acts to enhance the taste of highly ventilated and/or carbon filtered smoking articles to more closely correspond to the level of low-ventilated cigarettes and/or carbon-free filtered smoking articles. Carbon filtered smoking articles can be associated with a "carbon taste" by some smokers. However, the addition of at least one alkanoylated glycoside may help reduce the "carbon taste" some smokers associate with carbon filtration. Likewise, high levels of ventilation can also dilute mainstream smoke resulting in an off taste that can be offset by inclusion of the at least one alkanoylated glycoside as described herein.

Optionally, dry hops extract can also be added in addition to, or in lieu of, the at least one alkanoylated glycoside to the combustible smoking composition to further enhance the flavor of the mainstream smoke. When added, the dry hops extract can be included in an amount ranging from about 1 mg to about 50 mg per cigarette, more preferably about 2.5 mg to about 15 mg per cigarette. The addition of dry hops extract helps to provide a sensation of smoking a stronger cigarette by accentuating the harsh sensation of the smoke. The dry hops extract can be a hops powder extract, which is commercially available from Frutarom. In one embodiment, the dry hops extract can be added to the tobacco in powder form. In another embodiment, the dry hops extract may be combined with guar gum and tobacco to form reconstituted tobacco sheets, which may be used as wrappers or which may be chopped up and included in tobacco cut filler.

Also preferably, the combustible smoking composition includes tobacco. Any suitable tobacco material may be used for the smoking composition. Examples of suitable types of tobacco materials include flue-cured, Bright, Burley, Md. or Oriental tobaccos, the rare or specialty tobaccos, and blends thereof. The tobacco can be provided in the form of tobacco cut leaf filler, processed tobacco materials, such as volume expanded or puffed tobacco, processed tobacco stems, such as cut-rolled or cut-puffed stems, reconstituted tobacco materials or blends thereof. The tobacco can also include tobacco substitutes such as synthetic tobacco. Generally, the tobacco used to form a cigarette is aged.

In a preferred embodiment, the combustible smoking material contains tobacco or other material that is in the form of shreds or strands cut into widths ranging from about 0.10 inch to about 0.05 inch, more particularly, from about 0.10 inch to about 0.025 inch. In certain embodiments, the lengths of the strands generally range from between about 0.25 inches to about 3 inches. The smoking articles may further comprise one or more flavorants or other additives (e.g., sweeteners, humectants, non-tobacco flavorants, coloring agents, binders, etc.). In a particular embodiment, the smoking articles are cigarettes, more particularly, filtered cigarettes.

In a preferred embodiment, the smoking composition may be manufactured using any suitable technique. The alkanoylated glycoside may be added to cut filler tobacco stock supplied to a cigarette-making machine or applied to a preformed tobacco column prior to wrapping a cigarette wrapper around the tobacco column. For example, according to one embodiment, a method for manufacturing the smoking composition comprises the step of spraying tobacco with at least one alkanoylated glycoside. To facilitate spraying, the at least one alkanoylated glycoside can be added to a liquid carrier to form a slurry, and the slurry can be applied onto the tobacco. The tobacco smoking composition can then be processed for use in a cigarette or other smoking article.

Slurries comprising the alkanoylated glycoside can include any liquid or liquid mixtures suitable for dispersing and dispensing (e.g., spraying) particles of the alkanoylated glycoside. A preferred liquid is water (e.g., deionized water), though other liquids, such as alcohols, can be used. In a particularly preferred embodiment, the alkanoylated glycoside is dissolved in ethanol and injected directly into a tobacco rod after formation.

The concentration of alkanoylated glycoside in the slurry can be any amount suitable for dispensing the slurry onto tobacco. Slurries comprising a dispersion of alkanoylated glycoside in a liquid can comprise greater than about 0.5%, or greater than about 1% by weight of the alkanoylated glycoside.

Alkanoylated glycosides can be provided in the form of a dried powder and applied to tobacco material as such. If dried powder is used, it can be dusted onto tobacco and/or mixed with tobacco to form the combustible smoking composition.

Another technique for incorporating a alkanoylated glycoside in a tobacco smoking composition involves adding the alkanoylated glycoside to a slurry of ingredients used to make reconstituted tobacco. For example, the alkanoylated glycoside can be added to a reconstituted tobacco slurry in any suitable amount, wherein both the compound and the tobacco can be mixed together due to their water solubility.

The slurry, including the alkanoylated glycoside, can be formed into a reconstituted tobacco sheet and the sheet can be cut to shreds for incorporation as cut filler of a rod of smokable material or other smoking article.

As shown in FIG. 1, a smoking article 10 includes a rod 12 including the smoking composition described above, and a filter section 14. In a preferred embodiment, the smoking article 10 may also contain at least one sorbent. Tipping paper 16 typically surrounds the filter 14, which forms the buccal end 18 of the smoking article 10. The tipping paper 16 overlaps with the rod 12 in order to hold the filter 14 and rod 12 together. The rod 12, or tobacco containing element of the cigarette includes a wrapper 20 in which the rod 12 is wrapped and an adhesive can be used to hold the seams of the wrapper 20 together. In the preferred embodiment, the wrapper 20 is a paper wrapper. Also in the preferred embodiment, the rod 12 has a first end 22 which is integrally attached to the filter 14 and a second end 24 which is lit or heated when smoking. When the rod 12 is lit or heated for smoking, the smoke travels from the lit second end 24 downstream to the first end 22 of the tobacco rod and further downstream through the filter 14. The smoke passes through the filter 14 and through the buccal end 18 to a user's mouth.

In the preferred embodiment, the filter 14 is adapted to be incorporated in a filter cigarette. Filters 14 can be made by forming a bundle or tow of filter material into a rod using a rod forming apparatus. Typically, a filter rod comprises up to thirty thousand filaments of filter material. A preferred filter material used to form a filter rod is cellulose acetate, which is a cellulose ester. A plasticizer or binder such as triacetin can be added to the tow before it is passed into the rod forming apparatus.

Various filter constructions can be used to form the filter element. Exemplary filter structures include, but are not limited to, a mono filter, a dual filter, a triple filter, a cavity filter, a recessed filter, a free-flow filter or combinations thereof. Mono filters typically contain cellulose acetate tow or cellulose paper materials. Mono cellulose filters or paper filters can be effective filters for tar and/or nicotine. Dual filters typically comprise a cellulose acetate mouth end and a pure cellulose or cellulose acetate segment. The length and pressure drop of the segments in a dual filter can be adjusted to provide the desired filtration (i.e., adsorption and/or absorption) and resistance to draw (RTD).

In production of a cigarette, a smoking composition, such as the smoking composition described herein, can be combined with other cigarette additives and provided to a cigarette-making machine to produce a tobacco rod 12, which is then wrapped in the wrapper 20, and optionally tipped with a filter 14. The resulting cigarettes can be manufactured to desired specifications using standard or modified cigarette making techniques and equipment. Cigarettes may range from about 50 mm to about 120 mm in length. The circumference is typically from about 15 mm to about 30 mm, preferably around 25 mm. The tobacco packing density is typically between the range of about 100 mg/cm$^3$ to about 300 mg/cm$^3$, and more particularly about 150 mg/cm$^3$ to about 275 mg/cm$^3$.

In a preferred embodiment, the sorbent includes any suitable sorbent media. Exemplary sorbents include molecular sieves such as zeolites, silicas, silicates, aluminas, and/or carbons (e.g. activated carbon). A preferred sorbent media is activated carbon. Preferably, the filter assembly includes about 30 mg to about 200 mg of the sorbent.

By "activated carbon" is meant any porous, high surface area form of carbon. Activated carbon can be derived via thermal treatment of any suitable carbon source. The activation treatment typically increases the porosity, and activated carbon can be provided with a wide range of pore sizes or the pore sizes can be controlled to provide a desired pore size distribution.

In a preferred embodiment, the carbon is in the form of granules and the like. Preferably, the carbon of the preferred embodiment is a high surface area, activated carbon, for example a coconut shell based carbon of typical ASTM mesh size used in the cigarette industry or finer. A particularly preferred activated carbon is commercially available from PICA USA, Inc., Truth or Consequences, N. Mex. The activated carbon could also be manufactured via the carbonization of coal, wood, pitch, peat, cellulose fibers, lignite and olive pits. Carbonization is usually carried out at elevated temperatures, e.g., 400-1000° C. in an inert atmosphere, followed by activation (i.e., calcining) under reducing or oxidizing conditions.

In a preferred embodiment, the activated carbon can be in the form of beads. Activated carbon beads contained in the filter assembly preferably range in size from 0.20 mm to about 0.70 mm, as described in U.S. Patent Application Publication No. 2003/0154993, the entire content of which is incorporated herein by reference. In other embodiments, the activated carbon can be in the form of granules and/or fibers.

Alternatively, the activated carbon can comprise granulated particles ranging in size from about 100 microns to about 5 mm. In an embodiment, the particles of activated carbon have an average size of from about 0.2 to 2 mm (e.g., about 200, 500, 1000 or 2000 microns).

Preferably, the activated carbon is adapted to adsorb constituents of mainstream smoke, particularly, those of the gas phase including aldehydes, ketones and other volatile organic compounds, and in particular 1,3-butadiene, acrolein, isoprene, propionaldehyde, acrylonitrile, benzene, toluene, styrene, acetaldehyde and hydrogen cyanide (HCN). In other embodiments, the carbon can be in the form of carbon on tow and/or carbon paper.

Preferably, activated carbon can have any desired pore size distribution that comprises pores such as micropores, mesopores and macropores. The term "microporous" generally refers to such materials having pore sizes of about 20 Angstroms or less while the term "mesoporous" generally refers to such materials with pore sizes of about 20-500 Angstroms.

In an embodiment, the activated carbon can be selected to have an appropriate surface area to preferentially adsorb and/or absorb targeted constituents from smoke. For example, the preferred activated carbon typically has a surface area greater than about 50 $m^2/g$ (e.g., at least about 100, 200, 500, 1000 or 2000 $m^2/g$). Typically, the absorptive capacity of the activated carbon increases with increasing surface area. Furthermore, surface area typically increases with decreasing particle size. When used as filter media, however, carbon particles having a small particle size may pack together too densely to permit smoke to flow through the filter with desired resistance to draw (RTD) during smoking. On the other hand, if the particle size is too large there may be insufficient surface area to accomplish the desired degree of filtration. Therefore, such factors can be taken into account in selecting carbon particles suitable for filtration of mainstream and/or sidestream smoke.

Preferably at least some, if not all of the sorbent is flavor-bearing or otherwise impregnated with a flavor so that the sorbent is adapted not only to remove one or more gas phase smoke constituents from smoke, but also to release flavor into the mainstream smoke stream. For example, flavor can be added to activated carbon by spraying flavorant upon a batch of activated carbon in a mixing (tumbling) drum or alternatively in a fluidized bed with nitrogen as the fluidizing agent, wherein flavorant may then be sprayed onto the carbon in the bed.

In another embodiment, the smoking article can include a ventilation zone 40 comprising a plurality of ventilation holes which extend through the tipping paper 16. This arrangement facilitates the use of online laser perforation techniques to provide ventilation holes during the manufacture of the smoking article 10. Air may be drawn through the ventilation holes at zone 40, which mixes with and dilutes mainstream smoke during smoking.

Preferably, the ventilation zone 40 achieves a ventilation level of the smoking article of at least 25% and more preferably at least 50% to 90%.

In other embodiments, it may be desirable to provide several ventilating zones at locations along the filter and/or tobacco rod to achieve more elevated ventilation levels. The alkanoylated glycoside enhances the flavor of the mainstream smoke to offset any off taste associated with such elevated dilution levels. The optional dry hops extract can further offset any off taste associated with high ventilation levels, and may also enhance the flavor of smoking articles having carbon filtration systems.

A method of making a smoking article, such as a cigarette, can include (i) incorporating a alkanoylated glycoside in tobacco cut filler to form a combustible smoking composition; (ii) providing the smoking composition to a cigarette making machine to form a tobacco rod; (iii) placing the cigarette wrapper around the tobacco rod; and (iv) attaching a cigarette filter to the tobacco rod using tipping wrapper is provided. In cigarette production, a wrapper can be wrapped around the smoking composition to form a tobacco rod of a cigarette by a cigarette-making machine, which can be previously supplied or continuously supplied with the smoking composition and one or more ribbons of wrapper. Optionally, dry hops extract can also be added to the smoking composition.

Any conventional or modified cigarette making technique may be used to incorporate one or more alkanoylated glycosides into a cigarette. The cigarettes can be manufactured to any known specifications using standard or modified cigarette making techniques and equipment. The smoking composition, for example, is optionally combined with other cigarette additives, and provided to a cigarette-making machine to produce a tobacco rod, which is then wrapped in cigarette wrapper, and optionally tipped with filters.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred smoking composition including at least alkanoylated glycoside and methods of making the smoking composition with reference to a specific embodiment thereof, it will be apparent to one skilled in the art that various changes and modifications may be made to the smoking composition and equivalent methods may be employed, which do not materially depart from the spirit and scope of the foregoing description. Accordingly, all such changes, modifications, and equivalents that fall within the spirit and scope of the appended claims are intended to be encompassed thereby.

We claim:

1. A smoking article wherein tobacco is combusted during use, comprising:

a rod comprising a combustible tobacco smoking composition, said combustible tobacco smoking composition comprising tobacco and at least one alkanoylated glycoside of the formula:

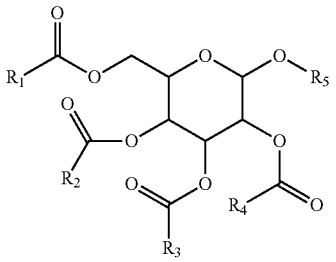

wherein R1, R2, R3 and R4 are selected from the group consisting of C1-C6 alkyl groups and H, and R5 is selected from the group consisting of H, a C1-C6 acyl group, a C1-C6 alkyl group, an aroyl group and an aryl group; and a filter disposed at an end of the rod comprising an activated carbon sorbent which in the absence of said alkanoylated glycoside imparts carbon taste to mainstream smoke during smoking, and wherein said alkanoylated glycoside is present in said rod comprising combustible tobacco smoking composition in an amount ranging from about 100 mg/kg of tobacco to about 300 mg/kg of tobacco such that when said tobacco smoking composition is combusted carbon taste associated with the presence of said activated carbon sorbent is offset.

2. The smoking article of claim 1, wherein said activated carbon sorbent of said filter is provided on a tow and said activated carbon sorbent is in the form consisting of carbon paper, carbon beads, carbon granules and carbon particles.

3. The smoking article of claim 1, wherein said activated carbon sorbent is included in said smoking article in an amount of about 30 mg to about 200 mg.

4. The smoking article of claim 1, wherein said smoking article is a cigar, a cigarette, or a cigarillo.

5. The smoking article of claim 1, wherein the combustible tobacco smoking composition further includes one or more of (a) at least one humectant; (b) at least one sweetener; (c) at least one non-tobacco flavorant; (d) at least one coloring agent and (e) at least one binder.

6. The smoking article of claim 1, wherein the combustible tobacco smoking composition further comprises hops extract.

7. The smoking article of claim 6, wherein the hops extract is dry hops extract and is included in the smoking article in an amount ranging from about 1 mg to about 50 mg per smoking article.

8. The smoking article of claim 1, wherein the alkanoylated glycoside is included in the combustible tobacco smoking composition in an amount ranging from about 150 mg/kg of tobacco to about 200 mg/kg of tobacco.

9. The smoking article of claim 1, further including at least one ventilation zone along a length of the smoking article.

10. The smoking article of claim 1, wherein the alkanoylated glycoside is included in the combustible tobacco smoking composition in an amount of about 185 mg/kg of tobacco.

* * * * *